US005875915A

United States Patent [19]

Bradshaw et al.

[11] Patent Number: 5,875,915

[45] Date of Patent: Mar. 2, 1999

[54] TWO PIECE CLOSURE FOR A CONTAINER

[75] Inventors: T. Gary Bradshaw, Sarasota, Fla.; Thomas Triner, Hebron, Ohio

[73] Assignee: Lobo Containers, Inc., Sarasota, Fla.

[21] Appl. No.: 965,091

[22] Filed: Nov. 6, 1997

[51] Int. Cl.[6] ..... B65D 45/32

[52] U.S. Cl. ..... 220/319; 215/276; 215/302; 215/320; 215/354; 206/508; 220/284; 220/288; 220/378; 220/380; 220/801; 220/803

[58] Field of Search ..... 215/274, 276, 215/DIG. 1, 318, 320, 330, 354, 302; 220/284, 288, 782, 789, 790, 319, 801–804, 378, 380, 101, 102; 206/508

[56] References Cited

U.S. PATENT DOCUMENTS

| | | | |
|---|---|---|---|
| 1,010,285 | 11/1911 | Mackin | 215/276 |
| 2,270,729 | 1/1942 | Geddes | 215/276 |
| 3,433,380 | 3/1969 | Kawchitch | 215/354 X |
| 3,491,908 | 1/1970 | Beimers | 215/276 |
| 3,532,244 | 10/1970 | Yates, Jr. | 215/DIG. 1 X |
| 3,788,510 | 1/1974 | Collins | 215/354 X |
| 4,034,886 | 7/1977 | Galer | 220/288 |
| 4,111,330 | 9/1978 | Jordan | 220/319 |
| 4,111,331 | 9/1978 | Summers . | |
| 4,116,352 | 9/1978 | Davis . | |
| 4,356,930 | 11/1982 | Roper | 206/508 X |
| 4,456,137 | 6/1984 | Lyman | 215/330 X |
| 4,518,097 | 5/1985 | Milton et al. | 220/790 X |
| 4,682,707 | 7/1987 | Wiles | 220/789 |
| 4,799,597 | 1/1989 | Mayes et al. | 215/330 X |
| 4,813,561 | 3/1989 | Ochs | 215/276 X |
| 4,896,782 | 1/1990 | Hawkins et al. . | |
| 4,930,647 | 6/1990 | Dutt et al. | 215/330 X |
| 4,991,731 | 2/1991 | Osip et al. . | |
| 5,213,225 | 5/1993 | King et al. | 215/330 |
| 5,259,526 | 11/1993 | Stolzman | 206/508 X |
| 5,301,853 | 4/1994 | Addison et al. | 220/803 X |
| 5,605,244 | 2/1997 | Bradshaw . | |

FOREIGN PATENT DOCUMENTS

| | | | |
|---|---|---|---|
| 2342908 | 9/1977 | France | 215/330 |
| 205626 | 11/1970 | Germany . | |
| 2405939 | 10/1974 | Germany | 215/274 |
| 2604540 | 8/1977 | Germany | 215/274 |

*Primary Examiner*—Allan N. Shoap
*Assistant Examiner*—Robin A. Hylton
*Attorney, Agent, or Firm*—Carothers & Carothers

[57] ABSTRACT

A composite closure for a container having a ring shaped cap with a ring shaped top and an annular skirt depending downwardly from the outer periphery of the top. The skirt is provided with internal threads for engaging external threads on the container neck. A disk shaped lid insert has its outer peripheral edge annularly received in an annular internal lid retaining groove in the cap which permits relative rotation between the lid insert and the threaded cap. An elastic annular seal is received in an annular groove provided in the bottom side of the lid insert for sealing the upper edge of a container.

8 Claims, 3 Drawing Sheets

TWO PIECE CLOSURE FOR A CONTAINER

BACKGROUND OF THE INVENTION

The present invention pertains to closures or lids for containers or drums provided for multiple use, including the containment of toxic waste or materials.

Such drum type containers are generally constructed of plastic, such as high density polyethylene, and they are corrosion resistant and have adequate mechanical strength combined with light weight such that they provide a light weight safe containment of hazardous or other materials without leaking, despite rough handling during transportation. Such containers when empty are also constructed to be stackable for space saving considerations.

Generally the plastic molded drums or containers in the range of from three gallon to fifty-five gallon capacity are provided with split ring metal chime clamps to facilitate the attachment of the lid to the container. These drums or containers are either employed as drum over packs for containing conventional metal drums therein filled with toxic materials, or they may be employed simply as containers for liquid or solid materials without the inclusion of a metal drum.

For most designs, the split ring clamp is provided with an annular inwardly facing groove that effects a deforming securement of the rim of the lid to the top or neck of the drum wall.

To assure a secured retention of the lid, designs for the lid securing structures are tested. For examples, specifications have been provided by a variety of commercial, international and government entities and the United States Department of Transportation (DOT), Research and Special Programs Administration. However, the Untied Nations has also set specifications which are even more rigorous.

Typically, drop tests are called for by the test procedures wherein samples taken at random are filled with dry finely powdered or liquid material to an authorized net weight and closed as for use. The containers so filled with dry powder or water, must withstand drop tests of varying heights upon specified parts without leakage or serious rupture. In one such drop, the top chime is dropped diagonally directly onto solid concrete. In another test, the bottom of the container is dropped diagonally such that the bottom chime contacts solid concrete. The drop test heights vary but generally average from four to six feet.

While drum-lid assemblies including split clamping rings have met the specifications as above required, 100% reliance upon split ring clamping assemblies to hold the lid and drum assemblies together during such drop tests has proven to be inadequate when dealing with the larger drums approaching the 55 gallon or higher drum capacity range.

The plastic and closure combination described in U.S. Pat. No. 5,605,244 and issued to the present inventor, minimizes the reliance upon split ring clamping assemblies to hold the lid and drum together. However, it is a principal object of the present invention to provide a safe and reliable closure and container combination which completely eliminates the requirement of a split ring clamping assembly.

SUMMARY OF THE INVENTION

The container closure of the present invention is a composite closure having a ring shaped cap with a ring shaped top and an annular skirt depending downwardly from the outer periphery of the top and this skirt is provided with internal threads for engaging external threads on the container neck. A disk shaped lid insert has its outer peripheral edge annularly received in an annular internal lid retaining groove provided in the ring cap. This retaining groove is positioned above the internal threads of the ring cap and this combination provides a unitary composite closure or lid which permits relative rotation between the lid insert and the ring shaped cap. An elastic annular seal member is received in an annular seal groove provided in the bottom side of the lid insert to engage the upper annular edge of the container and thereby provide a hermetic seal. This elastic sealing member may be an O-ring or alternatively may be a flowed-in gasket material.

In conventional lid and closure combinations, when the lid is threadably clamped down onto the neck of the container, the gasket overlying the upper edge of the container neck is caused to distort and crawl thereby providing a defective and undesirable seal preventing a tight seal between the lid and container.

With the composite closure of the present invention, when friction between the annular gasket and lid insert becomes such that the gasket might be caused to crawl and be distorted, the characteristics of the composite lid are such that the disk shaped lid insert at this point discontinues rotation and remains stationary with the gasket while the outer lid ring cap is permitted to continue to threadably clamp down on the neck of the threaded container.

This particular unitary construction is such that it is readily molded inexpensively of plastic and the unitary composite lid structure adds overall strength to the lid and provides equal engagement and seal all the way around the container upper end.

The disk shaped lid insert is provided with a downwardly depending plug portion for protruding into the interior of the container neck and thereby provides reinforcement for the lid insert. This plug is comprised of an annular skirt depending downwardly from the inner edge of the gasket seal groove thereby helping to confine and contain the annular seal to its proper position for correctly engaging the upper edge of the container.

Both the lid insert and the annular ring cap are readily and inexpensively constructed of molded plastic. Similarly, the container is also preferably of molded plastic.

Also, while not illustrated in the present disclosure, it is extremely desirable to provide the composite lid and container combination of the present invention with an anti-backoff locking mechanism to lock the lid in position when fully threaded down on the container neck to prevent accidental threadable dislodgement of the lid. Such an anti-backoff locking mechanism may be one of many types presently provided on the market or may consist of a spring biased plastic catch molded as a unitary part of the lid cap for reception into a lock detent molded into the shoulder of the container adjacent the threaded neck thereof.

The top of the ring shaped cap may also be provided with a castellated perimeter rim that upwardly protrudes from the ring shaped top of the cap. This provides space gaps around the cap perimeter for inserting a leverage bar such as a two-by-four or the like to assist threading and unthreading of the cap to or from the container neck.

BRIEF DESCRIPTION OF THE DRAWINGS

Other objects and advantages appear in the following description and claims.

The accompanying drawings show, for the purpose of exemplification, without limiting the invention or claims thereto, certain practical embodiments illustrating the principals of this invention wherein:

DESCRIPTION OF A PREFERRED EMBODIMENT

Figure 1:
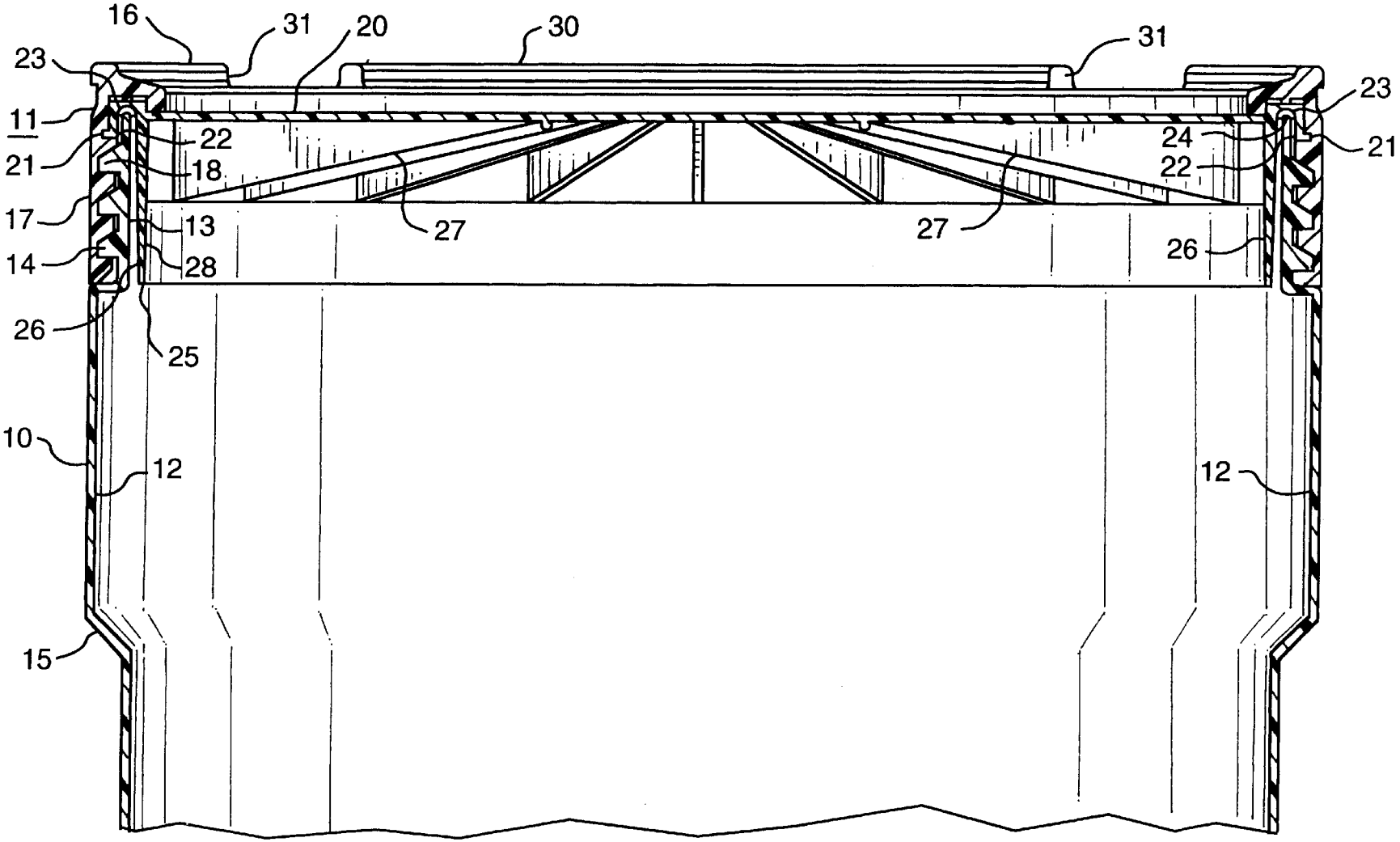
FIG. 1 is a view in side elevation showing the upper portion of the composite closure of the present invention secured to the upper end of a container with the closure and container shown in vertical mid cross section.

Referring to FIG. 1, the container 10 is a plastic container which is blow molded of high density polyethylene having a composite closure 11 of the present invention received on the upper end of the container.

The container 10 is provided with a tubular side wall 12 with an annular bottom (not shown) and a container neck 13 having external threads 14. Annular wall 12 is also provided with an annular shoulder 15 and in addition the annular wall 12 is tapered to permit conventional stacking of empty containers 10.

Composite closure 11 includes a ring shaped cap 16 of molded plastic having a ring shaped top and an annular skirt 17 depending downwardly from the outer periphery of top 16. Skirt 17 is provided with internal threads 18 for engaging the external threads 14 on container neck 13.

Closure 11 further includes disk shaped lid insert 20 having an outer peripheral edge 21 annularly received in annular internal lid retaining groove 22 in cap 16 such that this annular retaining groove is positioned above internal threads 18 for providing a unitary composite closure 11 which permits relative rotation between lid insert 20 and ring cap 16.

An annular seal member 23 in the form of an elastomeric O-ring is provided in annular seal groove 24 in the bottom side of lid insert 20 and this O-ring is dimensioned to engage the upper annular edge of container 10.

Annular seal groove 24 is also further defined by downwardly depending plug portion 25 which protrudes into the interior of container neck 13 and assists in reinforcing the lid insert 20.

Lid insert 20 is also molded of plastic and the plug portion 25 is provided in the form of an annular skirt 26 that depends downwardly from the inner edge seal groove 24. Reinforcing webs 27 are integrally molded into the plug portion 25 and secure the internal face 28 of plug skirt 26 with inner portions of the bottom side of lid insert 20 to provide a rigid and strong lid insert structure 20.

The ring cap 16 is provided with a castellated perimeter rim 30 protruding from ring shaped cap 16 that thereby provides spaced gaps 31 about the cap perimeter for inserting a leverage bar, such as a two-by-four or other leverage mechanism, to assist threading and unthreading of composite closure 11.

Figure 2:
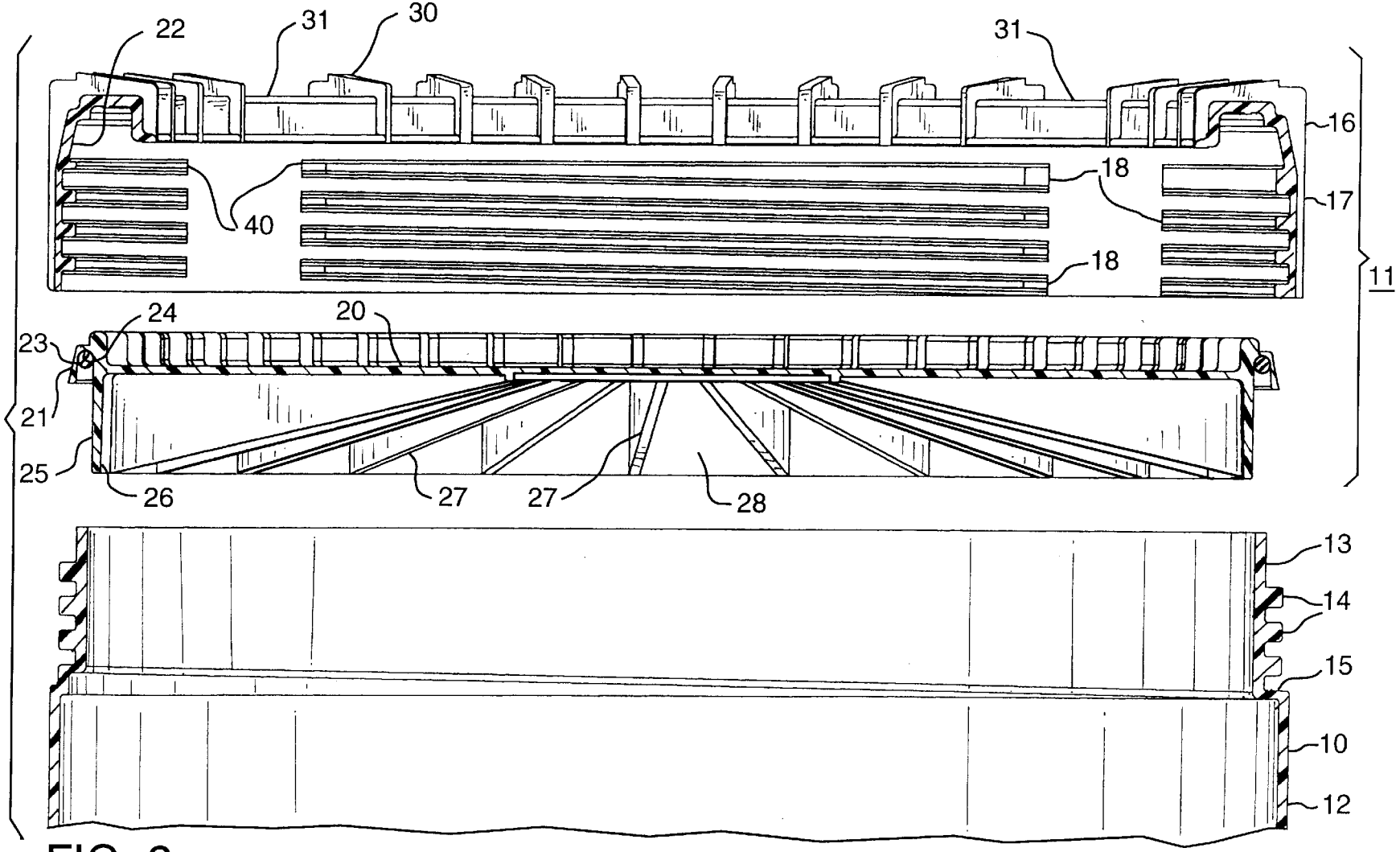
FIG. 2 is an exploded view in side elevation showing the upper portion of the composite closure of the present invention shown, in separated segments for clarity, and the upper end of a container with the closure and containers shown in vertical mid cross section and illustrating a modification of the structure illustrated in FIG. 1.

Referring next to FIG. 2, a variation in the composite closure shown in FIG. 1 is illustrated and the same or similar parts are therefore designated with the same reference numerals.

The main modifications in the embodiment shown in FIG. 2, as compared to the structure illustrated in FIG. 1, is that the outer peripheral edge 21 of disk shaped lid insert 20 is tapered instead of having a definite horizontally extending lip as indicated at 21 in FIG. 1. Additionally, the annular groove 22 for retaining the peripheral of edge 21 is defined by the upper surface of the upper most thread 40 of threads 18.

The arrangement is such that disk shaped lid insert 20 may therefore be pushed up into cap 16 until outer peripheral edge 21 annularly flexes and seats itself into corresponding lid retaining groove 22 in cap 16, instead of threading peripheral edge 21 up into cap 16 on threads 18. In other words, the embodiment illustrated in FIG. 2 permits one to initially engage disk shaped lid insert 20 with cap 16 by merely pushing insert 20 up into lid 16 until annular edge 21 is received in groove 22.

For the purposes of explanation, the gaps shown in threads 18 in FIG. 2 are merely provided to permit easy mold release when the cap 16 is being molded.

Figure 3:
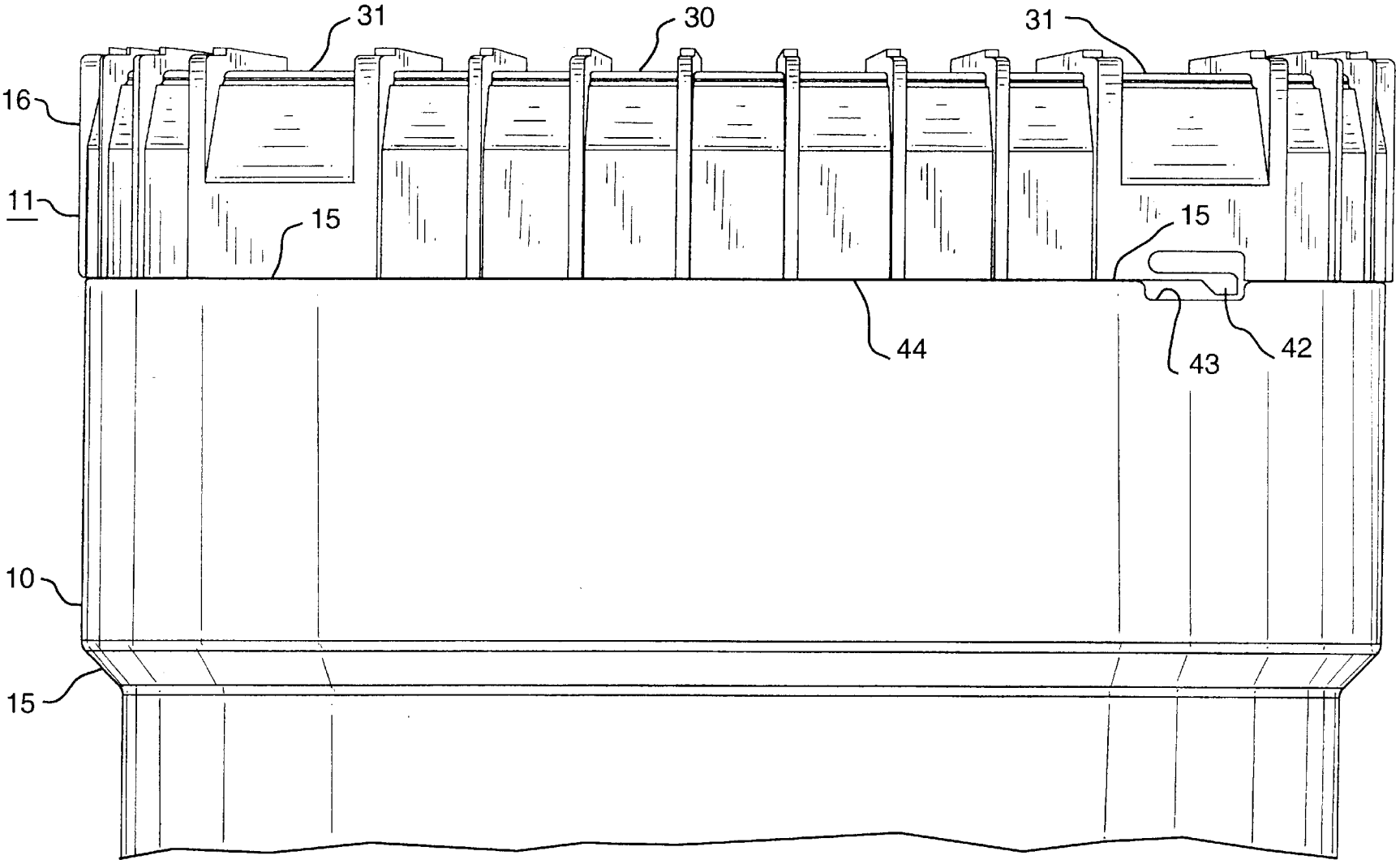
FIG. 3 is a view in side elevation showing the upper external portion of the composite closure of FIG. 2 secured onto the upper end of the container.

Referring next to FIG. 3, this figure illustrates the outside contours of the closure-container combination as shown in FIG. 2 and illustrates in particular the anti-backoff locking mechanism for cap 16.

A flexible lock catch 42 depends downwardly from the bottom peripheral edge 44 of cap annular skirt 26. A corresponding lock detent 43 is provided in container shoulder 15 for receiving and retaining cap lock catch 42 as illustrated when cap 16 is fully threaded on container neck 13. This accordingly provides an anti-backoff locking mechanism for cap 16 on container 10.

If the cap 16 must be later unthreaded from container 10, one may position a leverage mechanism in the detent 43 and thereby flex lock catch 42 upwardly so that the lid 16 may be unthreaded from neck 13 of container 10.

We claim:

1. A composite closure for a container, comprising:

a ring shaped cap having a ring shaped top and an annular skirt depending downwardly from an outer peripheral of said top and said skirt having internal threads for engaging external threads on a container neck;

a disk shaped lid insert having top and bottom faces and an outer peripheral edge annularly received in an annular internal lid retaining groove in said cap with said retaining groove positioned above said internal threads for providing a unitary composite closure with relative rotation permitted between said lid insert and said cap;

an elastic annular seal member received in an annular seal groove provided in the bottom side of said lid insert and dimensioned to engage an upper annular edge of a container;

said lid insert having a downwardly depending plug portion for protruding into the interior of a container neck and reinforcing said lid insert;

said plug comprised of an annular skirt depending downwardly from an inner edge of said seal groove; and said plug including reinforcing webs securing an internal face of said plug skirt with inner portions of the bottom side of said lid insert.

2. The composite closure of claim 1, wherein said lid insert is a molded plastic.

3. The composite closure of claim 2, wherein said cap is a molded plastic.

4. The composite closure of claim 3, including a castellated perimeter rim upwardly protruding from the ring shaped top of said cap and thereby providing spaced gaps about the cap perimeter for inserting a leverage bar to assist in threading and unthreading of said cap.

5. The composite closure of claim 1, wherein said elastic sealing member is an O-ring.

6. The composite closure of claim 1, wherein said elastic sealing member is flowed-in gasket material.

7. The composite closure of claim 1, wherein a container of molded plastic having external threads on an upper container neck dimensioned is provided for threadably mating and engaging said composite closure.

8. The composite closure of claim 7, said container having an upwardly facing and outwardly extending annular shoulder positioned adjacent and below said external threads on said container neck and thereby defining a bottom for said container neck, a flexible lock catch depending downwardly from a bottom peripheral edge of said cap annular skirt, and a lock detent in said container shoulder for receiving and retaining said cap lock catch when said cap is fully threaded on said container neck for thereby providing an anti-backoff locking mechanism for said cap.

* * * * *